US011075031B2

(12) United States Patent
Bramanpalli

(10) Patent No.: US 11,075,031 B2
(45) Date of Patent: Jul. 27, 2021

(54) INDUCTOR AND INDUCTOR ARRANGEMENT

(71) Applicant: Würth Elektronik eiSos GmbH & Co. KG, Waldenburg (DE)

(72) Inventor: Ranjith Bramanpalli, Waldenburg (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 442 days.

(21) Appl. No.: 16/058,159

(22) Filed: Aug. 8, 2018

(65) Prior Publication Data

US 2019/0051448 A1 Feb. 14, 2019

(30) Foreign Application Priority Data

Aug. 9, 2017 (EP) ..... 17185444

(51) Int. Cl.

| | |
|---|---|
| ***H01F 27/28*** | (2006.01) |
| ***H01F 27/38*** | (2006.01) |
| ***H01F 27/29*** | (2006.01) |
| ***H01F 27/40*** | (2006.01) |
| *H01F 27/36* | (2006.01) |

(52) U.S. Cl.

CPC ..... *H01F 27/289* (2013.01); *H01F 27/29* (2013.01); *H01F 27/38* (2013.01); *H01F 27/40* (2013.01); *H01F 27/36* (2013.01)

(58) Field of Classification Search

CPC .. H01F 27/288; H01F 27/2885; H01F 27/289; H01F 27/29; H01F 27/40

USPC ..... 336/84 R, 84 C, 84 M

See application file for complete search history.

(56) References Cited

U.S. PATENT DOCUMENTS

| | | | | |
|---|---|---|---|---|
| 2,553,324 | A * | 5/1951 | Lord | H01F 27/36 336/73 |
| 4,808,929 | A * | 2/1989 | Oldigs | G01V 3/28 324/339 |
| 5,166,655 | A | 11/1992 | Rogers | |
| 6,175,295 | B1 | 1/2001 | Honma | |
| 6,262,870 | B1 | 7/2001 | Yumoto | |
| 6,311,389 | B1 * | 11/2001 | Uosaki | G01R 33/3858 29/605 |
| 2010/0127815 | A1 * | 5/2010 | Damnjanovic | H01F 27/289 336/84 C |
| 2010/0295640 | A1 * | 11/2010 | Tamura | G01R 33/3815 335/216 |
| 2016/0189856 | A1 * | 6/2016 | Sarder | H01F 27/325 336/198 |
| 2018/0252551 | A1 | 9/2018 | Xie et al. | |

FOREIGN PATENT DOCUMENTS

| | | | |
|---|---|---|---|
| CH | 230 974 | A | 2/1944 |
| CH | 230974 | A | 2/1944 |
| CN | 2329089 | Y | 7/1999 |

(Continued)

*Primary Examiner* — Tszfung J Chan

(74) *Attorney, Agent, or Firm* — McGlew and Tuttle, P.C.

(57) ABSTRACT

An inductor comprises an excitation coil with an excitation coil axis and at least one shielding coil with a respective shielding coil axis. The excitation coil axis and the shielding coil axis define an angle δ, wherein applies: 60°≤δ≤120°, preferably 75°≤δ≤105°, and preferably 85°≤δ≤95°. The inductor is shielded and enables in an easy and flexible manner the attenuation of electric and magnetic fields.

20 Claims, 10 Drawing Sheets

(56) References Cited

FOREIGN PATENT DOCUMENTS

| | | | | | |
|---|---|---|---|---|---|
| CN | 104266665 | A | | 1/2015 | |
| EP | 2 998 971 | A1 | | 3/2016 | |
| EP | 2998971 | A1 | * | 3/2016 | ..... H01F 27/36 |
| GB | 2434488 | A | * | 7/2007 | ..... H01F 6/02 |
| KR | 101629890 | B1 | | 6/2016 | |
| TW | 425582 | B | | 3/2001 | |
| WO | 2011/122929 | A1 | | 10/2011 | |

* cited by examiner

INDUCTOR AND INDUCTOR ARRANGEMENT

CROSS-REFERENCES TO RELATED APPLICATIONS

This application claims the priority of European patent application, Serial No. 17 185 444.1, filed Aug. 9, 2017, pursuant to 35 U.S.C. 119(1)-(d), the content of which is incorporated herein by reference in its entirety as if fully set forth herein.

FIELD OF THE INVENTION

The invention relates to an inductor and an inductor arrangement comprising such an inductor.

BACKGROUND OF THE INVENTION

Achieving electromagnetic compatibility is a challenging task, since switching frequencies and transition times in switched-mode power supplies (SMPS) are increasing. Due to switching actions in switched-mode power supplies electric and magnetic fields are generated by inductors. To prevent excessive radiation of these fields, inductors are generally shielded.

U.S. Pat. No. 6,262,870 B1 discloses a switched power supply with a switching element that is connected to a switching transformer. The switching transformer comprises an annular ring which surrounds the transformer and is formed with an electrically conductive material. The annular ring suppresses or eliminates electrostatic interference caused by the structure and operation of the transformer.

SUMMARY OF THE INVENTION

It is an object of the present invention to provide an inductor that enables in an easy and flexible manner the attenuation of electric and magnetic fields. Preferably, it is an object of the present invention to provide an inductor that efficiently reduces the near field radiation and has a high shielding effectiveness.

This object is achieved by an inductor comprising an excitation coil with an excitation coil axis, at least one shielding coil with a respective shielding coil axis, in which the at least one shielding coil surrounds the excitation coil, in which the excitation coil is arranged in a shielding coil interior of the at least one shielding, in which the at least one shielding coil extends through an excitation coil interior of the excitation coil, and in which the excitation coil axis and the respective shielding coil axis (11; 11, 14) define an angle δ, wherein applies: $60° \leq \delta \leq 120°$, preferably $75° \leq \delta \leq 105°$, and preferably $85° \leq \delta \leq 95°$.

The electric and magnetic radiation of the excitation coil can be reduced in an easy and flexible manner by arranging the at least one shielding coil such that the angle δ between the excitation coil axis and the respective shielding coil axis is in the range of $60° \leq \delta \leq 120°$, preferably $75° \leq \delta \leq 105°$, and preferably $85° \leq \delta \leq 95°$. Preferably, the angle δ is 90°. The excitation coil axis is a longitudinal axis of the excitation coil, whereas the shielding coil axis is a longitudinal axis of the associated shielding coil. The excitation coil produces a magnetic field (H-field) which produces according to the Maxwell-Faraday equation an electric field (E-field) in perpendicular direction of the magnetic field and vice versa.

Due to the angle δ the at least one shielding coil efficiently suppresses the radiation of E-field and in consequence also the radiation of H-field. The inventive inductor has a high shielding effectiveness and enables the reduction of near field radiation. The shielding effectiveness can be adapted in an easy and flexible manner to a desired frequency by the number of shielding coils and/or the number of shielding coil layers and/or the diameter of the shielding coil wire. Preferably, the inductor has exactly one shielding coil. Due to the reduced component level radiation the inventive inductor is advantageously applicable in automotive applications.

Depending on a first pitch angle $\varphi_E$ of excitation coil windings of the excitation coil and a respective second pitch angle $\varphi_S$ of the at least one shielding coil, the excitation coil windings and the respective shielding coil windings define an angle α, wherein applies: $30° \leq \alpha \leq 150°$, preferably $45° \leq \alpha \leq 135°$, and preferably $60° \leq \alpha \leq 120°$. Preferably, the angle α is 90°.

The inductor enables in an easy and flexible manner the attenuation of electric and magnetic fields. By surrounding the excitation coil the at least one shielding coil effectively shields electric and magnetic fields in many different directions. At least one shielding coil winding surrounds all excitation coil windings. The at least one shielding coil defines a respective shielding coil interior. The shielding coil interior is limited by the shielding coil windings. The excitation coil is arranged at least partially in the shielding coil interior such that the shielding coil windings run around the excitation coil. The excitation coil defines an excitation coil interior. The excitation coil windings limit the excitation coil interior. By extending through the excitation coil interior the at least one shielding coil surrounds the excitation coil and effectively shields electric and magnetic fields. The shielding coil windings surround the excitation coil and thereby extend through the excitation coil interior.

An inductor, in which the angle δ is defined in a projection plane, which preferably runs in parallel to the excitation coil axis, enables in an easy and flexible manner the attenuation of electric and magnetic fields. The angle δ ensures an exact positioning of the at least one shielding coil in relation to the excitation coil. Preferably, the angle a is also defined in the projection plane.

An inductor, in which the excitation coil is a solenoid and the excitation coil axis is a straight line, enables in an easy manner the attenuation of electric and magnetic fields. Since the excitation coil axis is a straight line the at least one shielding coil can easily be positioned such that the respective shielding coil axis encloses the angle δ with the excitation coil axis.

An inductor, in which the respective shielding coil axis is a curved line and surrounds the excitation coil axis at least partially, enables in an easy and flexible manner the attenuation of electric and magnetic fields. Since the at least one shielding coil is designed such that the respective shielding coil axis is a curved line that surrounds the excitation coil axis at least partially, the electric and magnetic field radiation of the excitation coil can be shielded in many different directions. Therefore, the shielding effectiveness is high.

An inductor, in which the at least one shielding coil is a toroid and the respective shielding coil axis is a circular arc, efficiently reduces the radiation of electric and magnetic fields. Since the at least one shielding coil is a toroid the excitation coil is surrounded by the at least one shielding coil and electric and magnetic fields are shielded in many different directions. Therefore, the shielding effectiveness is high.

An inductor, in which the at least one shielding coil has shielding coil windings which have an oval shape, enables in an easy and flexible manner the attenuation of electric and magnetic fields. Due to the oval shape the shielding coil windings surround the excitation coil in an easy and flexible manner and the at least one shielding coil can be adapted to an axial length of the excitation coil. The shielding coil windings define the oval shape in a view along the respective shielding coil axis. Therefore, the at least one shielding coil efficiently reduces the radiation of electric and magnetic fields.

An inductor, in which a core is arranged in an excitation coil interior of the excitation coil and the at least one shielding coil extends between the core and the excitation coil, ensures a high shielding effectiveness. The at least one shielding coil extends between the core and the excitation coil such that the shielding coil windings surround the excitation coil and extend partially in the excitation coil interior. Despite of the core the at least one shielding coil enables the attenuation of electric and magnetic fields.

An inductor, in which the excitation coil and the respective shielding coil are fixed relative to each other by an insulating material, preferably by a resin, enables in an easy and flexible manner the attenuation of electric and magnetic fields. Due to the insulating material the excitation coil and the at least one shielding coil are fixed relative to each other with the desired angle δ. Preferably, the insulating material is a resin.

An inductor, in which the at least one shielding coil forms at least one shielding coil layer, wherein for a number N of the at least one shielding coil layer applies: $1 \leq N \leq 8$, preferably $2 \leq N \leq 4$, ensures in an easy and flexible manner the attenuation of electric and magnetic fields. The shielding effectiveness increases with the number N of shielding coil layers. Furthermore, the number N of shielding coil layers can be adapted to a desired range of frequency. Preferably, the at least one shielding coil has a shielding coil wire with a diameter d, wherein applies: 0.01 mm≤d≤3.2 mm, preferably 0.04 mm≤d≤1.0 mm, preferably 0.06 mm≤d≤0.6 mm, preferably 0.09 mm≤d≤0.2 mm.

In a first embodiment the inductor has exactly one shielding coil that comprises at least one shielding coil layer. In a second embodiment the inductor has at least two shielding coils, wherein each shielding coil has at least one shielding coil layer. The at least two shielding coils have an equal number or a different number of shielding coil layers. Preferably, each shielding coil has exactly one shielding coil layer such that the number of shielding coils is equal to the number N of shielding coil layers.

An inductor, in which the excitation coil and the at least one shielding coil are encased by a metal enclosure, efficiently reduces the radiation of electric and magnetic fields. The metal enclosure improves the shielding effectiveness since electric and magnetic fields, preferably electric and magnetic fields caused by the at least one shielding coil, are effectively reduced.

Furthermore, it is an object of the invention to provide an inductor arrangement that enables in an easy and flexible manner the attenuation of electric and magnetic fields of an inductor.

This object is achieved by an inductor arrangement comprising an inductor according to the invention, a reference node, wherein at least one pin of the at least one shielding coil is connected to the reference node. Each shielding coil has a first pin and a second pin. By connecting at least one pin of each shielding coil to the reference node the attenuation of electric and magnetic fields is effectively improved. The radiation of electric and magnetic fields caused by the excitation coil is effectively shielded by the at least one shielding coil. The first pin or the second pin or both pins of each shielding coil are connected to the reference node. For example, the reference node is a pin of the excitation coil or a base of the inductor arrangement. The reference node is preferably connected to ground. A pin of each shielding coil which is not connected to the reference node, is preferably not connected at all.

An inductor arrangement, in which the at least one pin is connected via a capacitor to the reference node, ensures the attenuation of electric and magnetic fields. By the capacitor the shielding effectiveness can be adapted to a desired range of frequency. For example, the first pin of the shielding coil is connected via a first capacitor to the reference node, whereas a second pin of the shielding coil is connected via a second capacitor to the reference node. By the capacitors the shielding effectiveness can be adapted to a desired frequency band.

Further features, advantages and details of the invention will be apparent from the following description of several embodiments which refer to the accompanying drawings.

DESCRIPTION OF THE PREFERRED EMBODIMENTS

FIGS. 1 to 6 show a first embodiment of the invention. An inductor arrangement 1 comprises an inductor 2 and a reference node R which is formed by a metal base 3 and connected to ground. For example, the metal base 3 is connected to a chassis of a vehicle.

Figure 1:
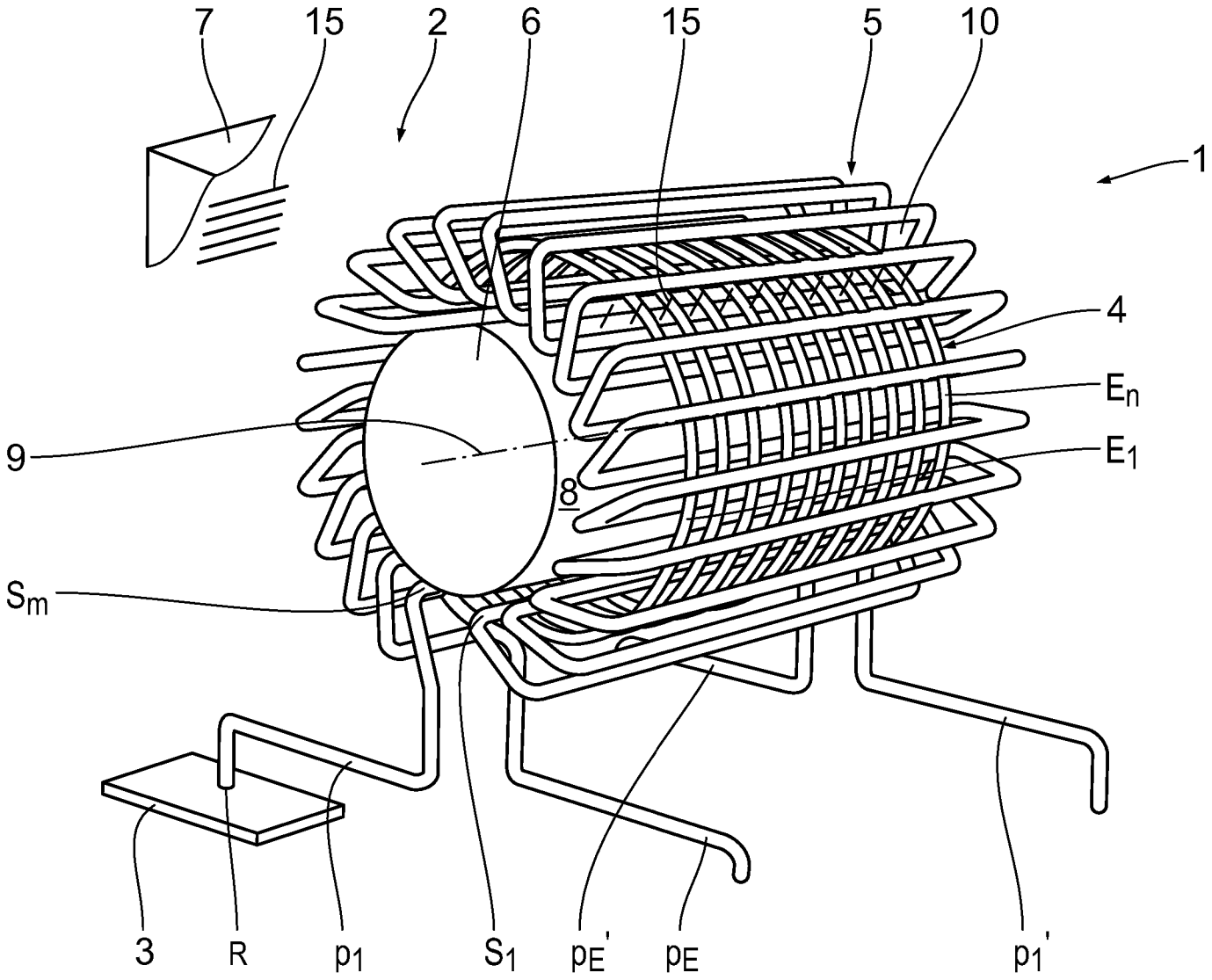
FIG. 1 shows an inductor arrangement according to a first embodiment of the invention.
Figure 2:
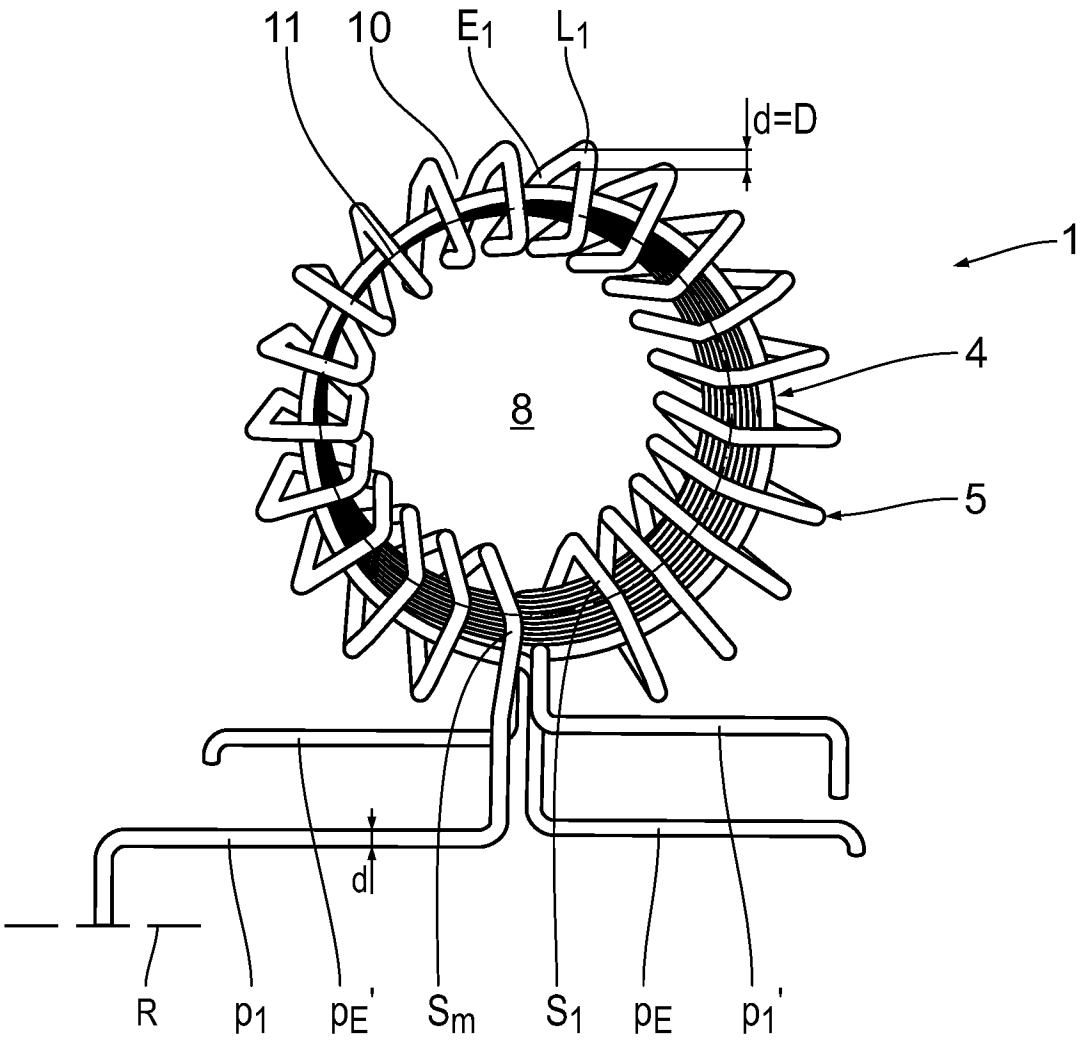
FIG. 2 shows a front view of an inductor in FIG. 1, but only with an excitation coil and a shielding coil and without a core and a metal enclosure.
Figure 3:
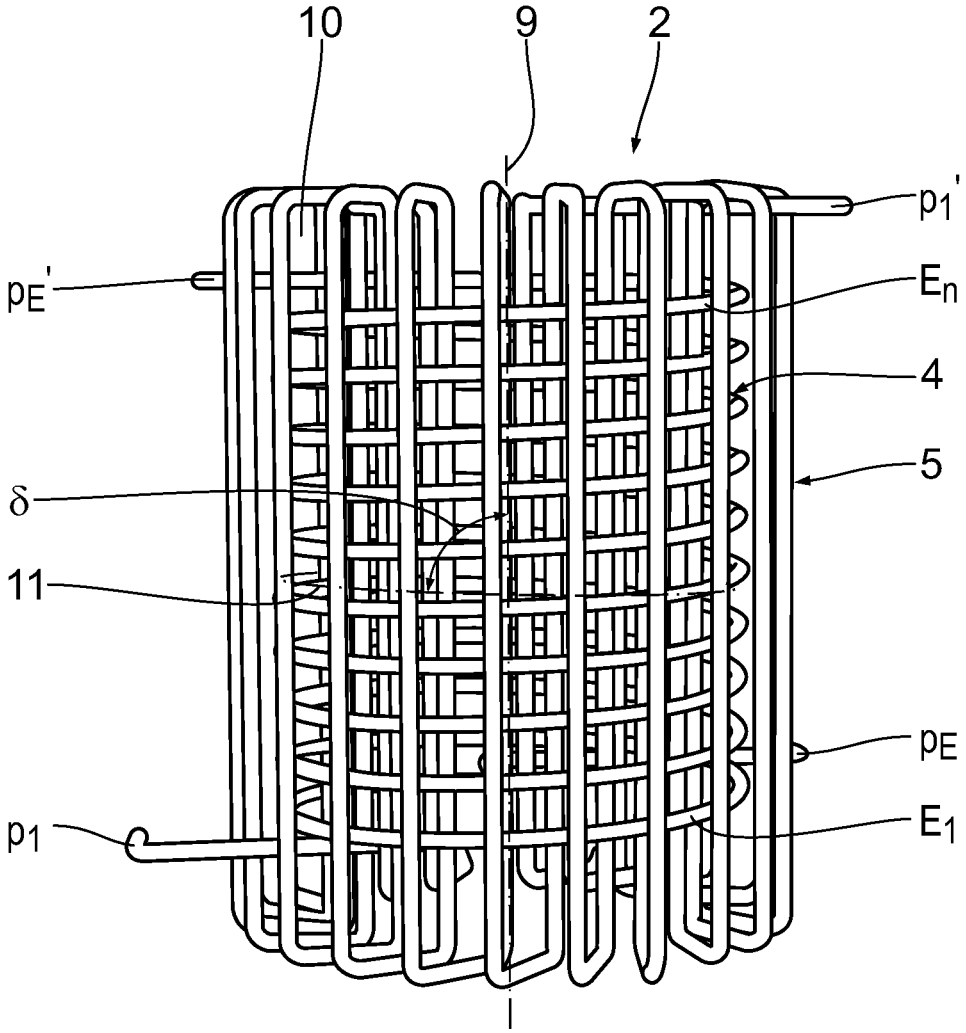
FIG. 3 shows a top view of the inductor in FIG. 2.
Figure 4:
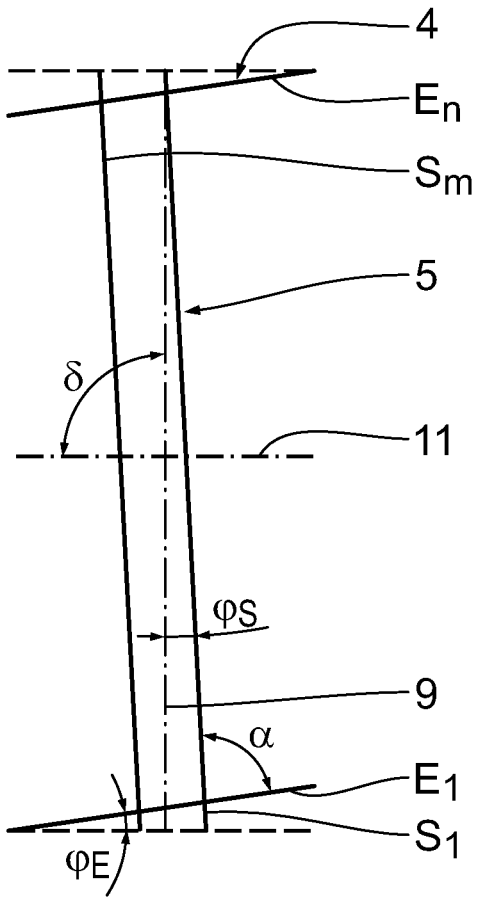
FIG. 4 shows a schematic view of the positioning of the excitation coil and the shielding coil in FIG. 3.

The inductor 2 comprises an excitation coil 4, a shielding coil 5, a magnetic core 6 and a metal enclosure 7. The metal enclosure 7 is shown in FIG. 1 merely partially.

The excitation coil 4 has several excitation coil windings $E_1$ to $E_n$ which limit an excitation coil interior 8 and define an longitudinal excitation coil axis 9. N is the number of excitation coil windings. The excitation coil 4 is a solenoid. The associated excitation coil axis 9 is arranged concentrically in the excitation coil interior 8 and has the shape of a straight line. The excitation coil 4 has a first pin $p_E$ and a second pin $p_E'$.

The shielding coil 5 has several shielding coil windings $S_1$ to $S_m$ which limit a shielding coil interior 10 and define a curved longitudinal shielding coil axis 11. M is the number of shielding coil windings. The shielding coil 5 is a toroid and the shielding coil axis 11 has the shape of a circular arc. The shielding coil 5 surrounds the excitation coil 4 such that the excitation coil 4 is arranged in the shielding coil interior 10. Hence, the shielding coil axis 11 which is a curved line in the shape of a circular arc concentrically surrounds the excitation coil axis 9. Since the shielding coil 5 surrounds the excitation coil 4 the shielding coil windings $S_1$ to $S_m$ extend through the excitation coil interior 8 and have an oval shape. The oval shape depends on an axial length of the excitation coil 4 and the number n of excitation coil windings $E_1$ to $E_n$. The shielding coil windings $S_1$ to $S_m$ extend through the excitation coil interior 8 and are arranged in a radial direction between the magnetic core 6 and the excitation coil 4.

The excitation coil 4 and the shielding coil 5 define in a projection plane P an angle δ, wherein applies: $60° \leq \delta \leq 120°$, preferably $75° \leq \delta < 105°$, and preferably $85° \leq \delta \leq 95°$. The projection plane P runs in parallel to the excitation coil axis 9. For example, the angle $\delta = 90°$. The angle δ describes a rotation or a rotational displacement between the excitation coil axis 9 and the shielding coil axis 11.

The excitation coil 4 has in relation to a plane which runs perpendicular to the excitation coil axis 9 a pitch angle $\varphi_E$, whereas the shielding coil 5 has in relation to a plane which runs perpendicular to the shielding coil axis 11 a pitch angle $\varphi_s$. Depending on the pitch angles $\varphi_E$ and $\varphi_s$ the excitation coil windings $E_1$ to $E_n$ and the shielding coil windings $S_1$ to $S_m$ define an angle α, wherein applies: $30° \leq \alpha \leq 150°$, preferably $45° \leq \alpha \leq 135°$, and preferably $60° \leq \alpha \leq 120°$.

The shielding coil 5 has a first pin $p_1$ and a second pin $p_1'$. The first pin $p_1$ is connected to the reference node R, whereas the second pin $p_1'$ is not connected at all.

The excitation coil 4, the shielding coil 5, the magnetic core 6 and the metal enclosure 7 are fixed relative to each other by an insulating material 15. The insulating material 15 is shown in FIG. 1 merely partially. For example, the insulating material 15 is resin which fixes the mentioned components by curing.

Figure 5:
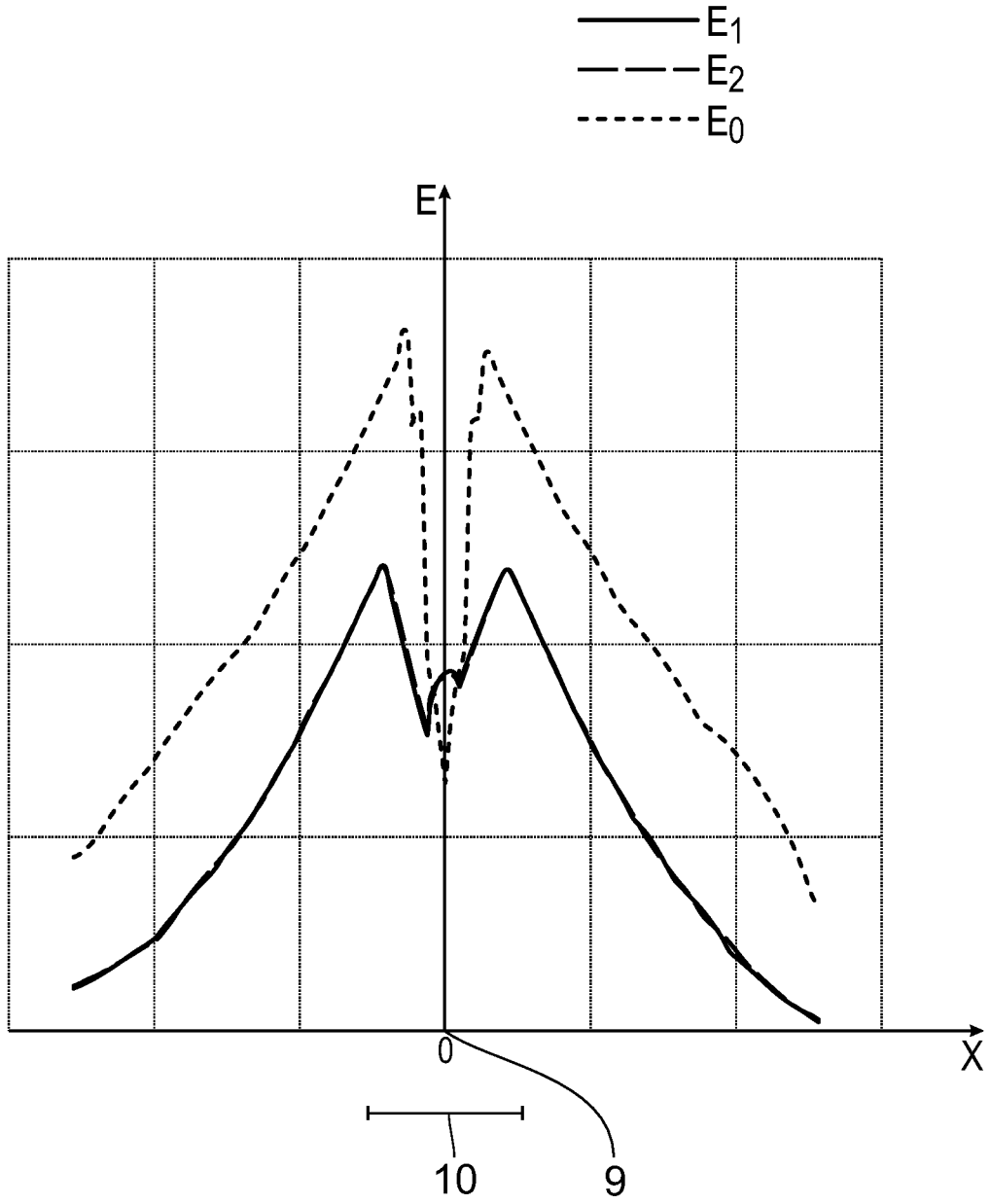
FIG. 5 shows a diagram of an electric field strength E depending on a radial distance x from an excitation coil axis.

The shielding coil 5 forms exactly one shielding coil layer $L_1$. Therefore, for a number N of shielding coil layers applies: N=1. The shielding coil 5 has a shielding coil wire with a diameter d, wherein applies: 0.01 mm≤d≤3.2 mm, preferably 0.05 mm≤d≤1.0 mm, preferably 0.06 mm≤d≤0.6 mm, preferably 0.09 mm≤d≤0.2 mm FIG. 5 shows the strength of the electric field (E-field) depending on the radial distance from the excitation coil axis 9. The x-coordinate is the radial distance from the excitation coil axis 9, whereas the y-coordinate is the strength of the electric field E. $E_0$ shows the strength of an electric field of the excitation coil 4 without the shielding coil 5. $E_1$ shows the strength of the electric field of the described inductor arrangement 1. $E_2$ shows the strength of the electric field in case that the second pin $p_1'$ is connected to the reference node R as well. The shielding coil 5 effectively reduces the radiation of the electric field and hence the radiation of the resulting magnetic field as well.

Figure 6:
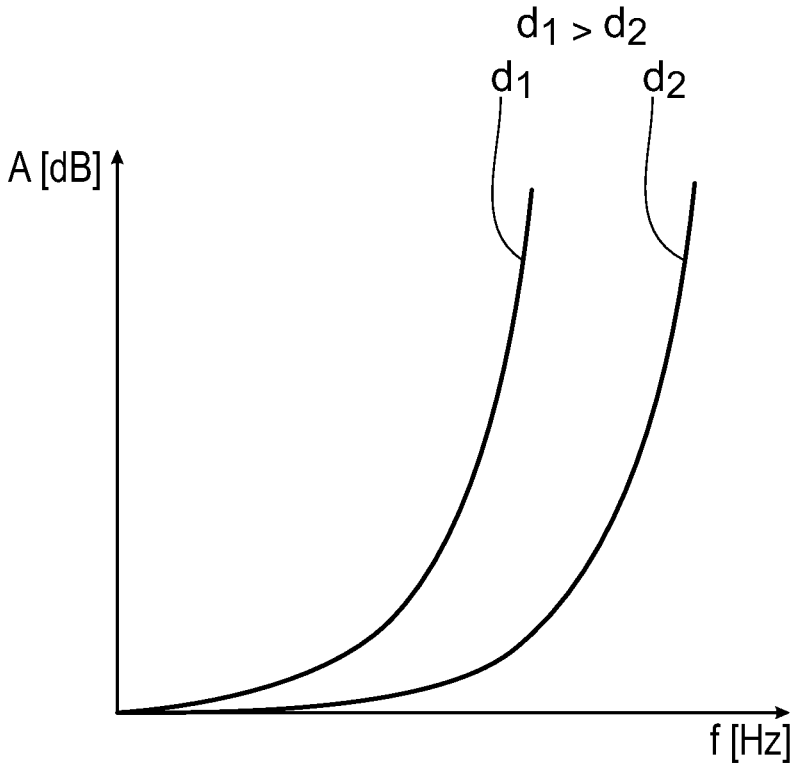
FIG. 6 shows a diagram of an attenuation A of the electric field depending on a frequency f and a diameter d of a shielding coil wire.

FIG. 6 shows a diagram of the attenuation A of the electric field depending on the frequency f for a first diameter $d_1$ of the shielding coil wire and a second diameter $d_2$ of the shielding coil wire, wherein $d_1 > d_2$. For example, the shielding coil wire is of copper. A thickness D of the shielding coil layer $L_1$ is dependent on and equal to the diameter d of the shielding coil wire. The diameter d of the shielding coil wire is adapted to the desired attenuation A at a desired frequency f. When the desired attenuation frequency increases, the skin depth decreases. Hence, the diameter d of the shielding coil wire decreases as well.

Figure 7:
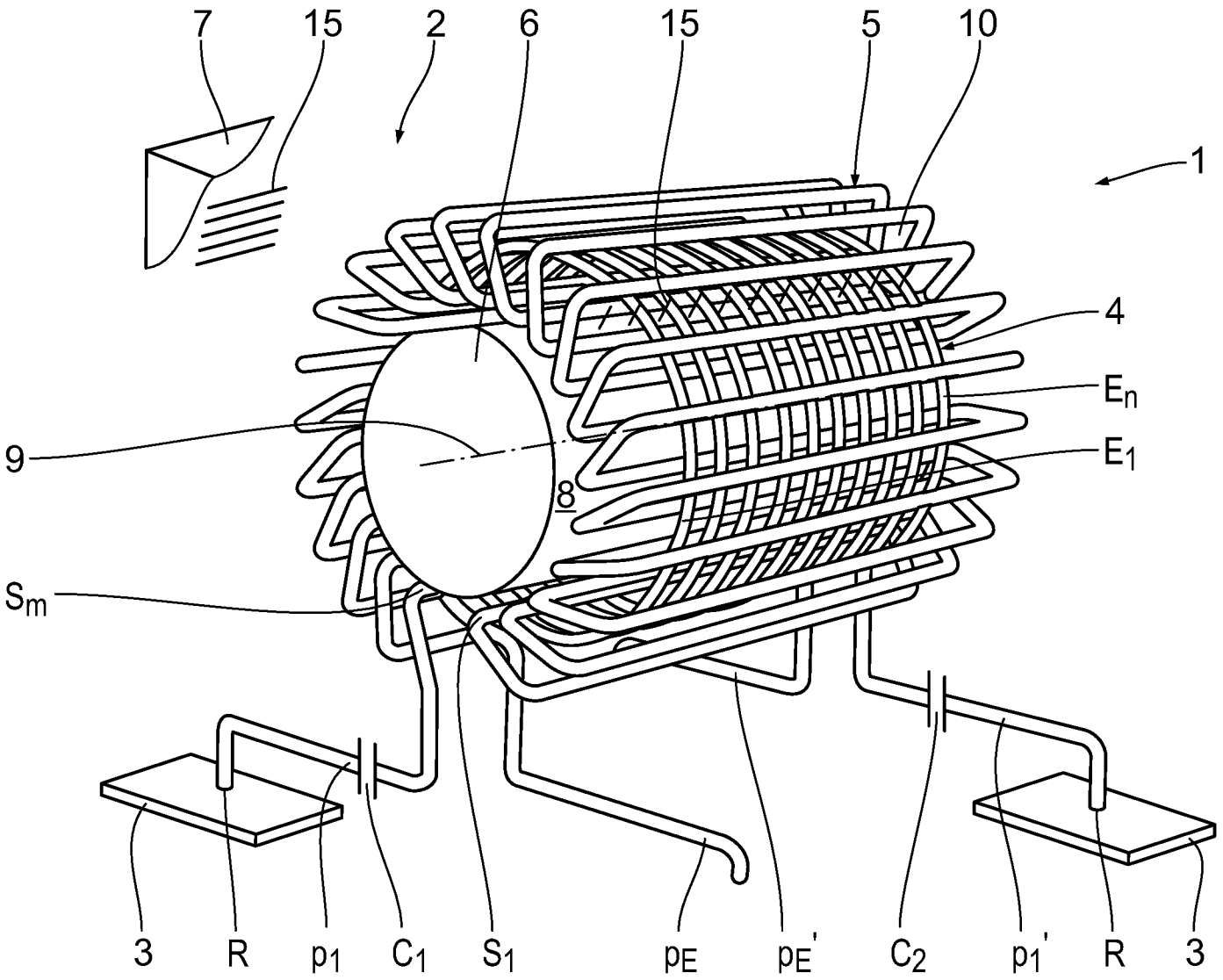
FIG. 7 shows an inductor arrangement according to a second embodiment of the invention.

FIG. 7 shows an inductor arrangement according to a second embodiment of the invention. In difference to the first embodiment the first pin $p_1$ is connected via a first capacitor $C_1$ to the reference node R and the second pin $p_1'$ is connected via a second capacitor $C_2$ to the reference node R. The capacitors $C_1$ and $C_2$ enable to adapt the attenuation of electric and magnetic fields to a desired band of frequency. Further details concerning the design and functioning of the inductor arrangement 1 can be found in the description of the first embodiment.

Figure 8:
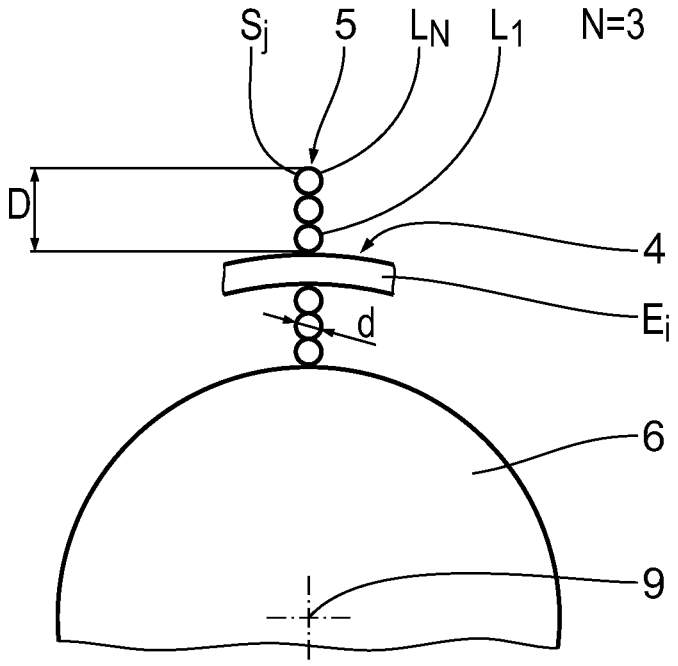
FIG. 8 shows an inductor arrangement according to a third embodiment of the invention, wherein the shielding coil forms several shielding coil layers.

FIG. 8 shows an inductor arrangement 1 according to a third embodiment of the invention. In difference to the proceeding embodiments the shielding coil 5 has a number N=3 of shielding coil layers $L_1$ to $L_N$. The shielding coil layers $L_1$ to $L_N$ form a thickness D which depends on the diameter d of the shielding coil wire and the number N. The number N of shielding coil layers $L_1$ to $L_N$, the thickness D of shielding coil layers $L_1$ to $L_N$ and the diameter d of the shielding coil wire is adapted to the desired attenuation of electric and magnetic fields at a desired frequency. $E_i$ denotes one of the excitation coil windings $E_1$ to $E_n$, whereas $S_j$ denotes one of the shielding coil windings $S_1$ to $S_m$. Further details concerning the design and the functioning of the inductor arrangement 1 can be found in the descriptions of the proceeding embodiments.

Figure 9:
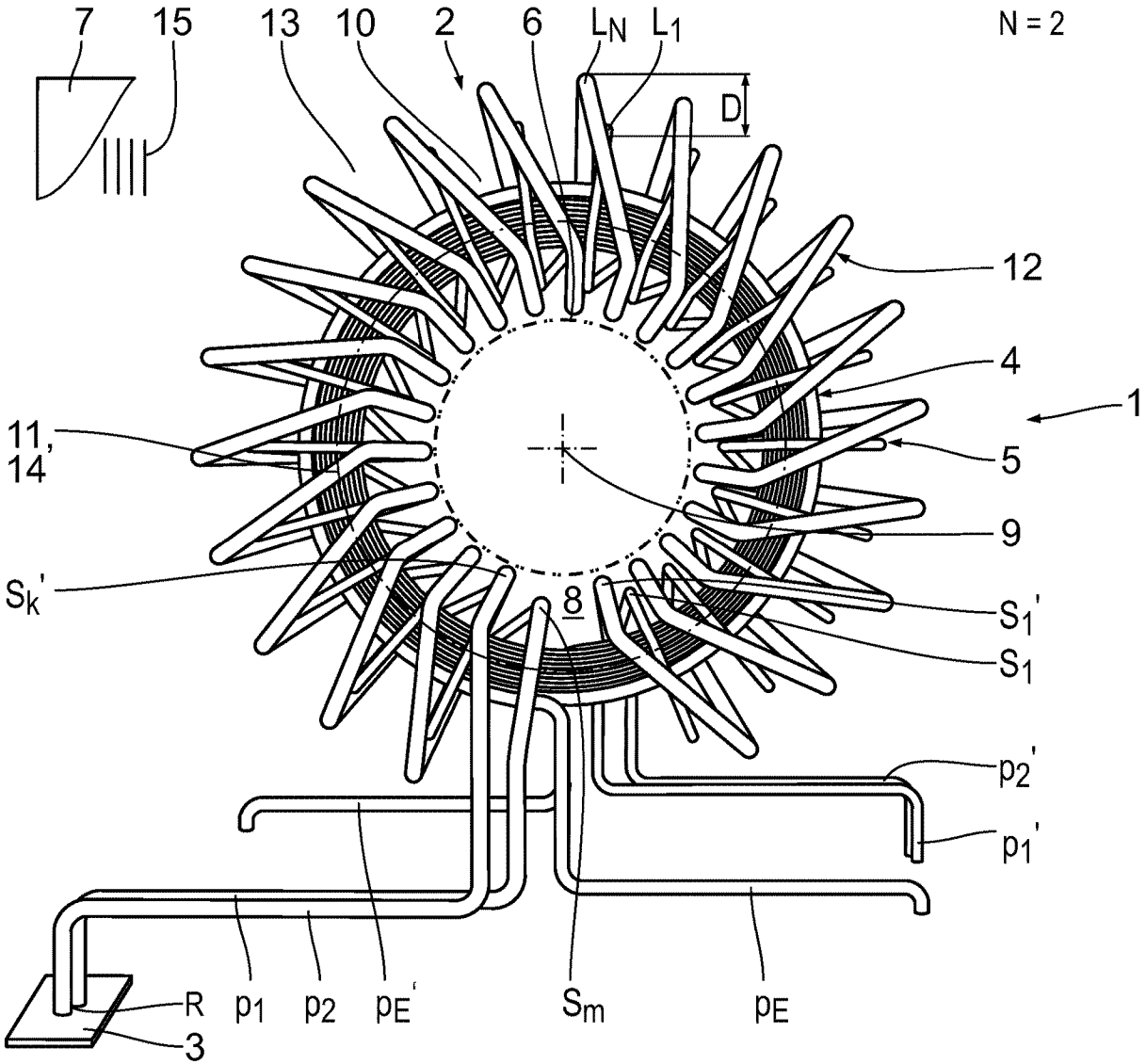
FIG. 9 shows an inductor arrangement according to a fourth embodiment of the invention with a first shielding coil and a second shielding coil.
Figure 10:
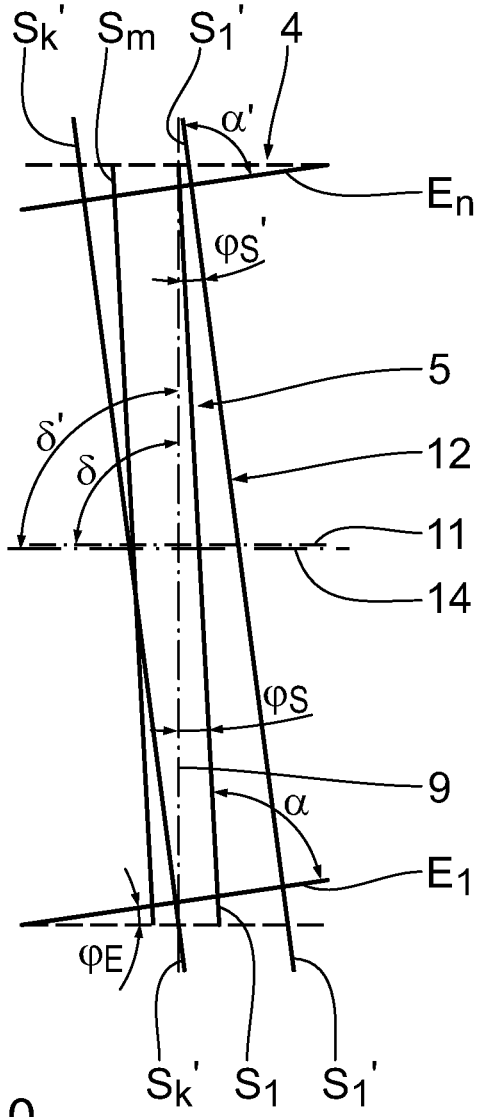
FIG. 10 shows a schematic view of the positioning of the excitation coil and the shielding coils in FIG. 9.

FIGS. 9 and 10 show an inductor arrangement 1 according to a fourth embodiment of the invention. In difference to the proceeding embodiments the inductor arrangement 1 comprises a first shielding coil 5 and a second shielding coil 12. The second shielding coil 12 has several shielding coil windings $S_1'$ to $S_k'$ which limit a second shielding coil interior 13 and define a second longitudinal shielding coil axis 14. The excitation coil 4 and the first shielding coil 5 are arranged in the second shielding coil interior 13. The second shielding coil 12 is a toroid and the second shielding coil axis 14 is a curved line in the shape of a circular arc which surrounds the excitation coil axis 11. The second shielding coil windings $S_1'$ to $S_k'$ extend through the excitation coil interior 8 and have an oval shape which depends on the axial length of the excitation coil 4.

The excitation coil axis 9 and the first shielding coil axis 11 define the angle δ, whereas the excitation coil axis 9 and the second shielding coil axis 14 define a corresponding angle δ'. For the angle δ' applies as well: $60° \leq \delta' \leq 120°$, preferably $75° \leq \delta' \leq 105°$, and preferably $85° \leq \delta' \leq 95°$. Preferably, $\delta = \delta'$ applies. The second shielding coil 12 has a second pitch angle $\varphi_s'$. The excitation coil windings $E_1$ to $E_n$ and the second shielding coil windings $S_1'$ to $S_k'$ define an angle α' which depends on the pitch angles $\varphi_E$ and $\varphi_s'$. For the angle α' applies: $30° \leq \alpha' \leq 150°$, preferably $45° \leq \alpha' \leq 135°$, and preferably $60° \leq \alpha' \leq 120°$.

The shielding coils 5, 12 form a number N=2 of shielding coil layers $L_1$ to $L_N$. The first pin $p_1$ of the first shielding coil 5 and a first pin $p_2$ of the second shielding coil 12 are connected to the reference node R. The second pin $p_1'$ of the first shielding coil 5 and a second pin $p_2'$ of the second shielding coil 12 are not connected. Further details concerning the design and functioning of the inductor arrangement 1 can be found in the descriptions of the proceedings embodiments.

The features of the inductor arrangements 1 and the associated inductors 2 can be combined with one another as desired to achieve the desired attenuation of electric and magnetic fields at a desired frequency and the desired shielding effectiveness.

What is claimed is:

1. An inductor, comprising:

an excitation coil with an excitation coil axis;

at least one shielding coil with a respective shielding coil axis, wherein the at least one shielding coil surrounds the excitation coil, wherein the excitation coil is arranged in a shielding coil interior of the at least one shielding coil, wherein the at least one shielding coil extends through an excitation coil interior of the excitation coil, wherein the excitation coil axis and the respective shielding coil axis define an angle δ, wherein applies: $60° \leq \delta \leq 120°$, wherein a magnetic core is arranged in the excitation coil interior of the excitation coil and the at least one shielding coil extends between the magnetic core and the excitation coil, wherein the magnetic core, the excitation coil and the respective shielding coil are fixed relative to each other by an insulating material.

2. An inductor according to claim 1, wherein the angle δ is defined in a projection plane, which runs in parallel to the excitation coil axis.

3. An inductor according to claim 1, wherein the excitation coil is a solenoid and the excitation coil axis is a straight line.

4. An inductor according to claim 1, wherein the respective shielding coil axis is a curved line and surrounds the excitation coil axis at least partially.

5. An inductor according to claim 1, wherein the at least one shielding coil is a toroid and the respective shielding coil axis is a circular arc.

6. An inductor according to claim 1, wherein the at least one shielding coil has shielding coil windings which have an oval shape.

7. An inductor according to claim 1, wherein the at least one shielding coil forms at least one shielding coil layer, wherein for a number N of the at least one shielding coil layer applies: $2 \leq N \leq 8$.

8. An inductor according to claim 1, wherein the excitation coil and the at least one shielding coil are encased by a metal enclosure.

9. An inductor arrangement, comprising:

an inductor comprising an excitation coil with an excitation coil axis and at least one shielding coil with a respective shielding coil axis, wherein the at least one shielding coil surrounds the excitation coil, wherein the excitation coil is arranged in a shielding coil interior of the at least one shielding coil, wherein the at least one shielding coil extends through an excitation coil interior of the excitation coil, wherein the excitation coil axis and the respective shielding coil axis define an angle δ, wherein applies: $60° \leq \delta \leq 120°$, wherein a magnetic core is arranged in the excitation coil interior of the excitation coil and the at least one shielding coil extends between the magnetic core and the excitation coil, wherein the magnetic core, the excitation coil and the respective shielding coil are fixed relative to each other by an insulating material;

a reference node, wherein at least one pin of the at least one shielding coil is connected to the reference node.

10. An inductor arrangement according to claim 9, wherein the at least one pin is connected via a capacitor to the reference node.

11. An inductor, comprising:

an excitation coil comprising an excitation coil axis;

a shielding coil comprising a shielding coil axis and a shielding coil interior space, the shielding coil surrounding at least a portion of the excitation coil, the portion of the excitation coil being arranged in the shielding coil interior space, the excitation coil axis and the shielding coil axis defining an angle, wherein the angle is greater than or equal to sixty degrees and the angle is less than or equal to one-hundred-and-twenty degrees;

a magnetic core comprising a magnetic core longitudinal axis, wherein the excitation coil and the shielding coil are located radially beyond the magnetic core with respect to the magnetic core longitudinal axis.

12. An inductor according to claim 11, further comprising an insulating material, the magnetic core, the excitation coil and the shielding coil being fixed relative to each other by the insulating material.

13. An inductor according to claim 12, wherein the excitation coil comprises an excitation coil interior space, the magnetic core being arranged in the excitation coil interior space, at least a portion of the shielding coil being provided in the excitation coil interior space.

14. An inductor according to claim 13, wherein the portion of the shielding coil extends between the magnetic core and the excitation coil.

15. An inductor according to claim 11, wherein the shielding coil comprises a shielding coil axial portion located between the excitation coil and the magnetic core.

16. An inductor according to claim 15, wherein the shielding coil comprises another shielding coil axial portion located radially beyond the excitation coil with respect to the magnetic core longitudinal axis, the shielding coil axial portion and the another shielding coil axial portion extending in an axial direction with respect to the magnetic core longitudinal axis.

17. An inductor according to claim 16, wherein the shielding coil comprises a shielding coil radial portion, wherein one end of the shielding coil axial portion is connected to one end of the another shielding coil axial portion via the shielding coil radial portion.

18. An inductor according to claim 17, wherein the shielding coil comprises another shielding coil radial portion, wherein another end of the shielding coil axial portion is connected to another end of the another shielding coil axial portion via the another shielding coil radial portion, the shielding coil radial portion and the another shielding coil radial portion extending in a radial direction with respect to the magnetic core longitudinal axis.

19. An inductor according to claim 17, wherein the shielding coil radial portion, the another shielding coil radial portion, the shielding coil axial portion and the another shielding coil axial portion define the shielding coil interior space.

20. An inductor according to claim 17, wherein the shielding coil radial portion extends axially beyond the excitation coil with respect to the magnetic core longitudinal axis.

* * * * *